US006707763B2

(12) United States Patent
Osberg et al.

(10) Patent No.: US 6,707,763 B2
(45) Date of Patent: Mar. 16, 2004

(54) CLOSURE CAP INCLUDING TIMER AND COOPERATING SWITCH MEMBER AND ASSOCIATED METHODS

(75) Inventors: James Alan Osberg, Palm City, FL (US); Chin Chang Franchi, Stuart, FL (US); Daryl Osberg, Southlake, TX (US)

(73) Assignee: Diduminder Corporation, Palm City, FL (US)

( * ) Notice: Subject to any disclaimer, the term of this patent is extended or adjusted under 35 U.S.C. 154(b) by 0 days.

(21) Appl. No.: 10/062,137

(22) Filed: Feb. 1, 2002

(65) Prior Publication Data

US 2002/0126585 A1 Sep. 12, 2002

Related U.S. Application Data

(60) Provisional application No. 60/266,153, filed on Feb. 2, 2001, and provisional application No. 60/341,177, filed on Dec. 13, 2001.

(51) Int. Cl.[7] ..... G04B 47/00; G08B 1/00; G07F 11/00

(52) U.S. Cl. ..... 368/10; 368/12; 340/309.4; 221/2

(58) Field of Search ..... 368/10, 12; 340/309.15; 221/2

(56) References Cited

U.S. PATENT DOCUMENTS

| | | | | |
|---|---|---|---|---|
| 4,367,955 A | * | 1/1983 | Ballew | 368/10 |
| D282,446 S | | 2/1986 | Gremonprez et al. | D10/40 |
| 4,862,431 A | * | 8/1989 | Drouin | 368/10 |
| 4,939,705 A | * | 7/1990 | Hamilton et al. | 368/10 |
| 5,233,571 A | * | 8/1993 | Wirtschafter | 368/10 |
| 5,239,491 A | * | 8/1993 | Mucciacciaro | 702/177 |
| 5,720,392 A | | 2/1998 | Price | 206/534 |
| 5,751,661 A | | 5/1998 | Walters | 368/10 |
| 5,852,590 A | * | 12/1998 | de la Huerga | 368/10 |
| 6,084,504 A | * | 7/2000 | Rosche et al. | 340/309.15 |
| 6,158,613 A | * | 12/2000 | Novosel et al. | 221/3 |
| 6,324,123 B1 | * | 11/2001 | Durso | 368/10 |
| 6,424,599 B1 | * | 7/2002 | Ditzig | 368/10 |

* cited by examiner

*Primary Examiner*—David Martin
*Assistant Examiner*—Michael L. Lindinger
(74) *Attorney, Agent, or Firm*—Allen, Dyer, Doppelt, Milbrath & Gilchrist, P.A.

(57) ABSTRACT

A closure cap including a housing including a lower housing portion, an enlarged upper housing portion and defining a shoulder therebetween. The closure cap also includes a switch member being biased outwardly from the shoulder and movable between an outwardly extending position and a retracted position. A timer is carried by the housing and cooperates with the switch member for generating an indication relating to a length of time that the switch member has been in the retracted positioned and corresponding to a time since the closure cap was most recently secured onto the pill container. A child-proof adaptor ring may be removably carried by the housing.

29 Claims, 2 Drawing Sheets

CLOSURE CAP INCLUDING TIMER AND COOPERATING SWITCH MEMBER AND ASSOCIATED METHODS

RELATED APPLICATIONS

The present application claims the benefit of Provisional Patent Application Serial No. 60/266,153, filed on Feb. 2, 2001, titled MEDICATION RECORDING CLOCK and Provisional Patent Application Serial No. 60/341,177, filed on Dec. 13, 2001, titled DUAL CHILD-RESISTANT AND DISPENSING CLOSURE both of which are incorporated herein by reference in their entireties.

FIELD OF THE INVENTION

The present invention relates to the field of containers, and, more particularly, to closure caps for pill containers and associated methods.

BACKGROUND OF THE INVENTION

A closure cap is typically used to selectively cover the open upper end of a container, such as used for pills or medication. One problem that arises with medication, both prescription and nonprescription, is that patients sometimes do not remember to take the medication at the designated times e.g., every four hours. Alternately, sometimes patients do not remember when the last time that medication was taken. In an attempt to address these problems, various timers have been developed.

For example, U.S. Pat. No. 5,751,661 titled "Medication Dosage Timing Apparatus" to Walters describes a closure cap having an integral timer. The timer is activated and deactivated by a moveable disk that engages and disengages a battery beneath the timer. The timer cap, and more specifically, the moveable disk, described in the Walters patent, however, may be somewhat awkward and unreliable. The disk may stick in position if it is not properly aligned. Accordingly, the timer cap described in the patent may be difficult to manipulate and may not provide an accurate indication of time.

Similarly, U.S. Pat. No. 6,324,123 titled "Medication Timer" to Durso describes a programmable medication timer on a closure cap that indicates the appropriate time for the user to take medication. The timer described in the Durso patent, however, is relatively complicated and requires specific programming to remind the user to take medication.

Current closure caps are generally adapted for use either with child-proof containers or containers having threaded openings. Moreover, a timer cap adapted for a pill container having a threaded opening cannot be used on a child-proof container, and vice-versa.

SUMMARY OF THE INVENTION

In view of the foregoing background, it is therefore an object of the present invention to provide a closure cap that is reliable and which may also be compatible with both child-proof pill containers, e.g., child-resistant pill containers and pill containers having a threaded opening, e.g., senior-friendly pill containers.

This and other objects, features, and advantages in accordance with the present invention are provided by a closure cap comprising a lower housing portion and an enlarged upper housing portion connected thereto and defining a shoulder therebetween. The shoulder engages adjacent upper portions of the pill container when the closure cap is secured thereon. The closure cap also preferably includes a switch member being biased outwardly from an opening in the shoulder. The switch member is movable between an outwardly extending position and a retracted position based upon contact with adjacent upper portions of the pill container as the closure cap is secured thereon. The closure cap further preferably includes a timer carried by the housing and cooperating with the switch member for generating an indication relating to a length of time that the switch member has been in the retracted positioned. The length of time corresponds to a time since the closure cap was most recently secured onto the pill container. Accordingly, the closure cap provides a relatively straightforward and reliable timing function for the user.

The timer preferably includes a display and circuitry connected thereto for displaying the length of time since the switch member was most recently moved to the retracted position. The display may include a digital display. The closure cap further preferably includes a battery carried by the housing for powering the circuitry. The switch member may comprise a generally cylindrical pin that has rounded-over end edges. The lower housing portion preferably includes a threaded outer surface portion and the upper housing portion preferably includes an outer gripping surface having a plurality of vertically extending ridges. In accordance with another aspect of the invention, the closure cap may also include a removable child-proof adaptor ring to be carried by the housing to adapt the housing to engage a child-proof locking mechanism of the pill container. The removable child-proof adaptor ring preferably includes an upper portion engaging adjacent outer surface portions of the upper housing portion and a lower portion connected to the upper portion and being in radially spaced apart relation from adjacent surface portions of the lower housing portion. In other words, the closure cap can also advantageously be interchangeably used between child-proof pill containers and pill containers having threaded portions adjacent the opening.

The objects, features, and advantages in accordance with the present invention are also provided by a method for generating an indication relating to a length of time since a closure cap was most recently secured to a pill container. The method includes providing a housing having a lower housing portion and an enlarged upper housing portion connected thereto and defining a shoulder therebetween. The shoulder engages adjacent upper portions of the pill container when the closure cap is secured thereon. The method also includes biasing a switch member outwardly from an opening in the shoulder. The switch member is movable between an outwardly extending position and a retracted position based upon contact with adjacent upper portions of the pill container as the closure cap is secured thereon. The method also includes generating an indication relating to a length of time since the closure cap was most recently secured to the pill container based upon a length of time since the switch member was most recently moved to the retracted position.

The objects, features, and advantages in accordance with the present invention are further provided by a method for adapting a closure cap from use with a pill container having threads to use with a pill container comprising a child-proof locking mechanism. The closure cap includes a timer and a housing carrying the timer. The housing includes a threaded outer surface portion to engage threads of a pill container. The method includes biasing a switch member from the housing that is movable between an outwardly extending position and a retracted position based upon contact with adjacent upper portions of the pill container as the closure cap is secured thereon. The switch member cooperates with the timer. The method also includes engaging a removable child-proof adaptor ring onto the housing to adapt the housing to engage the child-proof locking mechanism of a pill container.

BRIEF DESCRIPTION OF THE DRAWINGS

Some of the features, advantages, and benefits of the present invention having been stated, others will become apparent as the description proceeds when taken in conjunction with the accompanying drawings in which.

DETAILED DESCRIPTION OF THE PREFERRED EMBODIMENTS

Figure 1:
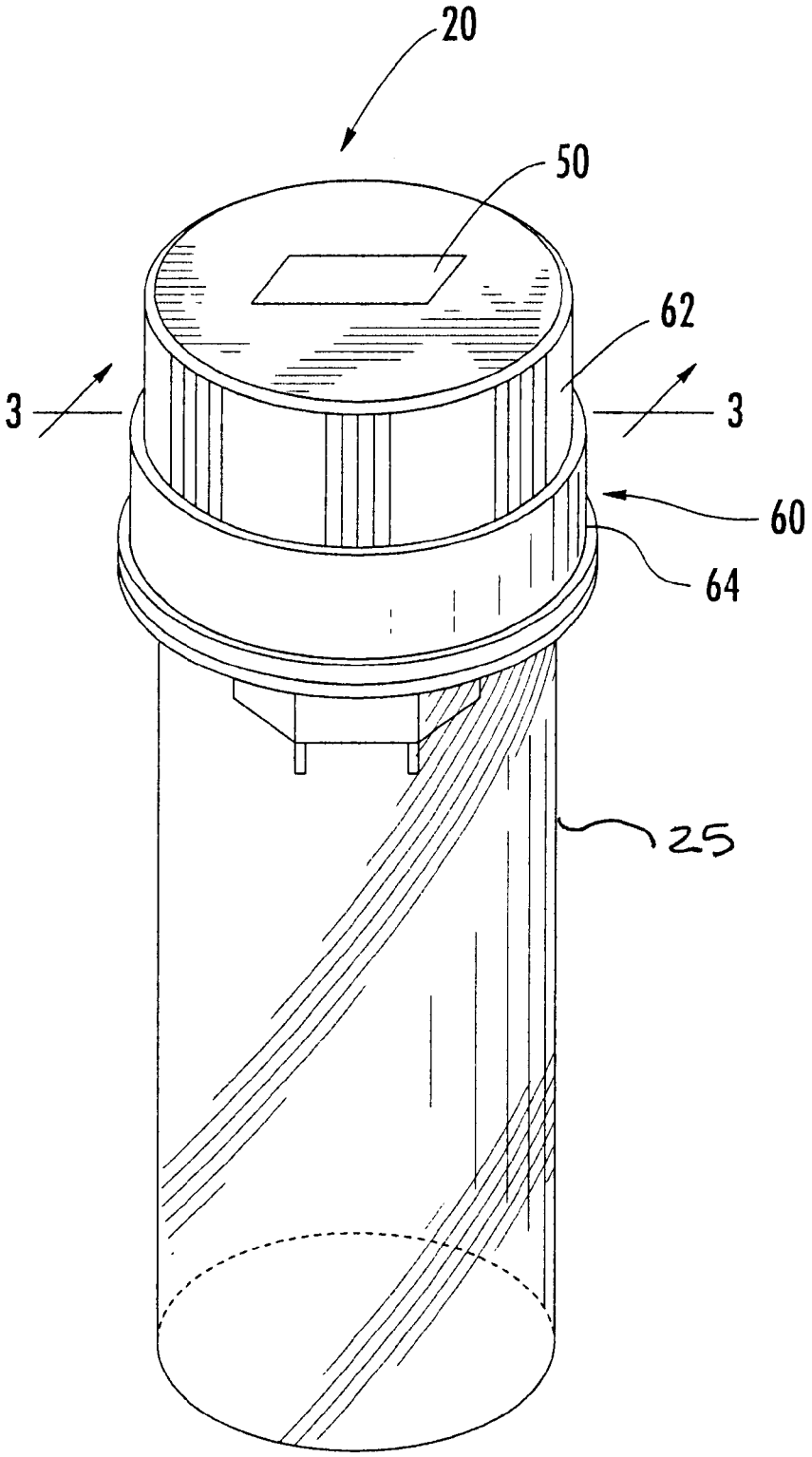
FIG. 1 is a perspective view of a closure cap connected to a pill container according to the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

As best illustrated in FIGS. 1–4, the closure cap 20 includes a housing 30 having a lower housing portion 33 and an enlarged upper housing portion 32 connected thereto and defining a shoulder 34 therebetween. The shoulder 34 engages adjacent upper portions of the pill container 25 when the closure cap 20 is secured thereon. As perhaps best illustrated in FIG. 3, the shoulder 34 has an opening 35 formed therein.

A switch member 40 is biased outwardly from the opening 35 in the shoulder 34 and is movable between an outwardly extending position and a retracted position based upon contact with adjacent upper portions of the pill container 25 as the closure cap 20 is secured thereon. The switch member 40 can be made of metal, for example. The switch member 40 is biased outwardly by a spring carried within the upper housing portion 32. The switch member 40 cooperates with switch contacts carried within the upper housing portion 32 to define a switch which is open when in the outwardly extending position and closed when in the retracted position. The switch member 40 can be provided by a generally cylindrical pin having rounded-over end edges as shown in the illustrated embodiments.

The closure cap 20 also includes a timer 50 carried by the housing 30 and cooperating with the switch member 40 for generating an indication relating to a length of time that the switch member has been in the retracted positioned and corresponding to a time since the closure cap was most recently secured onto the pill container 25. Therefore, when the switch member 40 is in the retracted position, the timer 50 displays the length of time that the switch member has been in the retracted position. This is an effective indication of when the last time that medication was taken.

Figure 3:
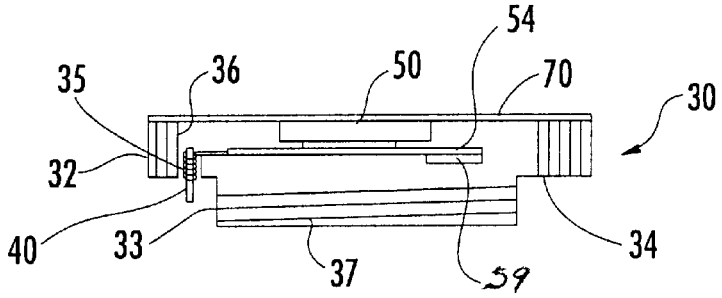
FIG. 3. is a cross-sectional view of the closure cap taken through line 3—3 in FIG. 1.

As perhaps best illustrated in FIG. 3, the timer 50 includes a display 52 and circuitry 54 connected thereto for displaying the length of time since the switch member 40 was most recently moved to the retracted position. The display 52 is preferably a digital display, but can also be provided by any other type of display suitable for displaying the elapsed time since the closure cap 20 was most recently secured to the pill container 25, as understood by those skilled in the art. The closure cap 20 further includes a battery 56 carried by the housing 30 for powering the circuitry 54. More particularly, the circuitry 54 can include a 4-bit micro-controller, and the display 52 may be a 4-character 7-segment LCD display. The battery 56 can be provided by a 1.5 volt lithium battery, for example.

When the closure cap 20 is secured to the pill container 25, the switch member 40 is moved to the retracted position and the timer 50 begins to track the time that the closure cap 20 has been secured to the pill container 25. When the closure cap 20 is removed from the pill container 25, the switch member 40 is moved to the outwardly extending position and the timer 50 is turned off, i.e., the timer 50 stops tracking and displaying the elapsed time. When the closure cap 20 is secured to the pill container again, the timer 50 is reset and the elapsed time is tracked again since the closure cap 20 was last secured to the pill container.

Figure 4:
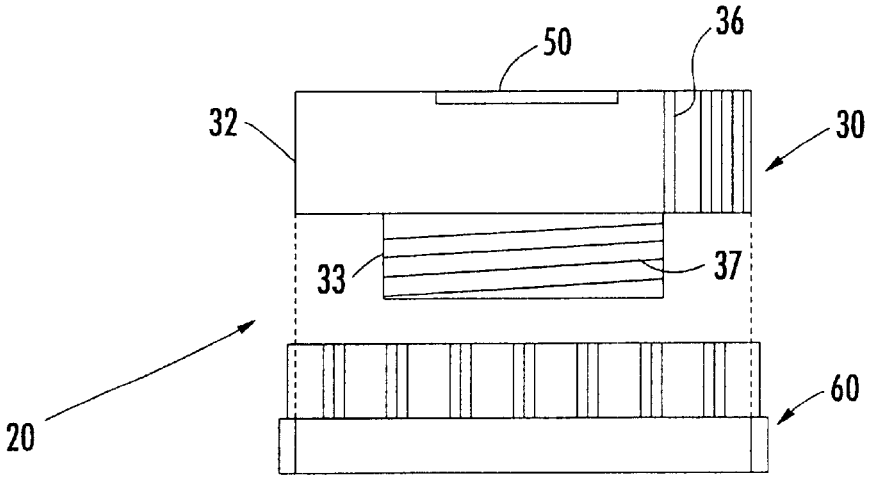
FIG. 4 is an exploded side view of the closure cap as shown in FIG. 1.

As perhaps best illustrated in FIGS. 3 and 4, the lower housing portion 33 includes a threaded outer surface portion 37 and the upper housing portion 32 includes an outer gripping surface 36. The threaded outer surface 37 of the lower housing portion 33 is adapted to engage corresponding threaded surfaces of the pill container 25 so that the closure cap 20 can be readily secured to the pill container 25. The outer gripping surface 36 illustratively includes a plurality of vertically extending ridges. The vertically extending edges advantageously allow a user to readily grip the closure cap 20 so that weaker users can manipulate the closure cap 20.

The closure cap 20 may also include a removable child-proof adaptor ring 60 to be carried by the housing 30 to adapt the housing to engage a child-proof locking mechanism of the pill container 25. More particularly, the removable child-proof adaptor ring 60 allows the closure cap to be used with any type of container that uses a child-proof or child-resistant opening, e.g., containers for household detergents, cosmetics, bleach, or any other type of container used to carry material that may be harmful if ingested, as understood by those skilled in the art. The removable child-proof adaptor ring 60 illustratively includes an upper portion 62 engaging adjacent outer surface portions of the upper housing portion 32 and a lower portion 64 connected to the upper portion 62 and being in radially spaced apart relation from adjacent surface portions of the lower housing portion 33. Therefore, the housing 30 can be readily inserted into the removable child-proof adaptor ring 60 so that the closure cap 20 can be secured to a child-proof pill container as well as to a pill container having a threaded opening. The housing 30 and child-proof adaptor cap 60 are preferably made of plastic, but any lightweight and flexible material can also be used as understood by those skilled in the art.

The removable child-proof adaptor ring 60 preferably includes a plurality of tabs extending outwardly from the inner peripheral portions of the lower portion 64. The plurality of tabs preferably engage a plurality of tabs extending from the pill container 25 so that the child-proof adaptor cap 60 is securely locked when positioned on the child-proof pill container. The pill container 25 is defined as a child-proof pill container because it includes a child-proof lock. The child-proof lock can advantageously be disengaged by depressing a tab, for example, extending outwardly from the pill container 25. When the child-proof lock is disengaged, the closure cap 20 can be readily removed from the child-proof pill container. The child-proof or child-resistant lock on the pill container can also advantageously be provided by a push-turn mechanism, for example, or any other type of child-proof or child-resistant lock as understood by those skilled in the art.

Although the removable child-proof adaptor ring 60 has been described as being used in connection with a closure cap 20 having a timer 50 associated therewith, it shall be understood that the removable child-proof adaptor ring can also advantageously be used with a closure cap 20 that does not have a timer associated therewith. Furthermore, when the removable child-proof adaptor ring 60 is removed from the closure cap 20 it can advantageously be positioned in a storage position over the closure cap. In other words, the upper portion of the removable child-proof adaptor ring matingly engages the upper housing portion of the closure cap so that when the closure cap is secured to the pill container, the removable child-proof adaptor ring is removably connected thereto.

Figure 2:
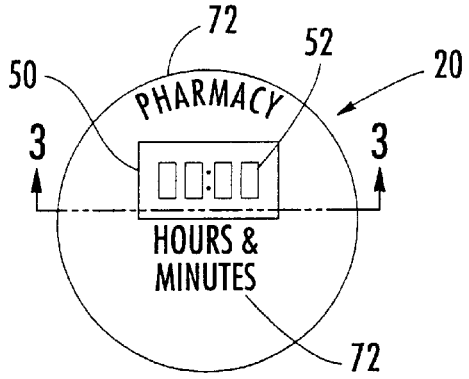
FIG. 2 is a top plan view of the closure cap as shown in FIG. 1.

As perhaps best illustrated in FIGS. 2 and 3, the closure cap 20 can also include a lens 70, that overlies the timer 50 and connects to inner peripheral portions of the upper housing portion 32. The lens 70 is preferably a transparent plastic material that protects the timer 50 on the upper housing portion 32. Indicia 72 can advantageously be positioned on the lens 70. The indicia 72 can, for example, be advertising indicia or medication instructions, or any other type of indicia as understood by those skilled in the art.

Another aspect of the invention is directed to a method for generating an indication relating to a length of time since a closure cap 20 was most recently secured onto a pill container 25. The method includes providing a housing 30 including a lower housing portion 33 and an enlarged upper housing portion 32 connected thereto and defining a shoulder 34 therebetween. The shoulder 34 engages adjacent upper portions of the pill container 25 when the closure cap 20 is secured thereon. The shoulder 34 has an opening 35 formed therein. The method also includes biasing a switch member 40 outwardly from the opening 35 in the shoulder 34 and generating an indication relating to a length of time since the closure cap 20 was most recently secured onto a pill container 25. The method also includes moving the switch member 40 between an outwardly extending position and a retracted position based upon contact with adjacent upper portions of the pill container 25 as the closure cap 20 is secured thereon. The step of generating also includes displaying the length of time since the switch member 40 was most recently moved to the retracted position using a timer 50 carried by the housing 30.

Yet another aspect of the invention is directed to a method for adapting a closure cap 20 from use with a pill container 25 having threads to use with a pill container 25 having a child-proof locking mechanism. The closure cap 20 includes a timer 50 and a housing 30 carrying the timer 50. The housing 30 includes a threaded outer surface portion to engage threads of pill container 25. The method includes biasing a switch member 40 from the housing 30. The switch member 40 is movable between an outwardly extending position and a retracted position based upon contact with adjacent upper portions of the pill container 25 as the closure cap 20 is secured thereon. The switch member cooperates with the timer 50. The method also includes engaging a removable child-proof adaptor ring 60 onto the housing 30 to adapt the housing to engage the child-proof locking mechanism of a pill container 25.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed is:

1. A closure cap for a pill container comprising:

a housing comprising a lower housing portion and an enlarged upper housing portion connected thereto and defining a shoulder therebetween, the shoulder engaging adjacent upper portions of the pill container when the closure cap is secured thereon, the shoulder having an opening therein;

a switch member being biased outwardly from the opening in the shoulder and being movable between an outwardly extending position and a retracted position based upon contact with adjacent upper portions of the pill container as the closure cap is secured thereon; and a timer carried by said housing and cooperating with said switch member for generating an indication relating to a length of time that the switch member has been in the retracted positioned and corresponding to a time since the closure cap was most recently secured onto the pill container.

2. A closure cap according to claim 1 wherein said timer comprises a display and circuitry connected thereto for displaying the length of time since the switch member was most recently moved to the retracted position.

3. A closure cap according to claim 2 wherein said display comprises a digital display.

4. A closure cap according to claim 2 further comprising a battery carried by said housing for powering said circuitry.

5. A closure cap according to claim 1 wherein said switch member comprises a cylindrical pin.

6. A closure cap according to claim 5 wherein said cylindrical pin has rounded-over end edges.

7. A closure cap according to claim 1 wherein the lower housing portion comprises a threaded outer surface portion.

8. A closure cap according to claim 1 wherein the upper housing portion comprises an outer gripping surface.

9. A closure cap according to claim 8 wherein the outer gripping surface comprises a plurality of vertically extending ridges.

10. A closure cap according to claim 1 further comprising a removable child-proof adaptor ring to be carried by said housing to adapt said housing to engage a child-proof locking mechanism of the pill container.

11. A closure cap according to claim 10 wherein said removable child-proof adaptor ring comprises:

an upper portion engaging adjacent outer surface portions of the upper housing portion; and a lower portion connected to said upper portion and being in radially spaced apart relation from adjacent surface portions of the lower housing portion.

12. A closure cap according to claim 1 wherein said housing comprises plastic.

13. A closure cap for pill containers of a type including at least one of threads and a child-proof locking mechanism, the closure cap comprising:

a housing comprising a shoulder portion and a threaded outer surface portion to engage the threads of a pill container;

a switch member carried by said shoulder portion of housing and being movable between an outwardly extending position and a retracted position based upon contact with adjacent upper portions of the pill container as the closure cap is secured thereon;

a timer carried by said housing and cooperating with said switch member; and a removable child-proof adaptor ring to be carried by said housing to adapt said housing to engage the child-proof locking mechanism of a pill container.

14. A closure cap according to claim 13 wherein said timer generates an indication relating to a length of time since the switch member was most recently moved to the retracted position and corresponding to a time since the closure cap was most recently secured onto the pill container.

15. A closure cap according to claim 14 wherein said timer comprises a display and circuitry connected thereto for displaying the length of time that the switch member was most recently moved to the retracted position.

16. A closure cap according to claim 13 wherein said housing comprises a lower housing portion and an enlarged upper housing portion connected thereto and defining a shoulder therebetween, the shoulder engaging adjacent upper portions of the pill container when the closure cap is secured thereon, the shoulder having an opening therein receiving the switch member.

17. A closure cap according to claim 16 wherein said removable child-proof adaptor ring comprises:

an upper portion engaging adjacent outer surface portions of the upper housing portion; and a lower portion connected to said upper portion and being in radially spaced apart relation from adjacent surface portions of the lower housing portion.

18. A closure cap according to claim 13 wherein said switch member comprises a cylindrical pin.

19. A method for generating an indication relating to a length of time since a closure cap was most recently secured onto a pill container, the method comprising:

providing a housing comprising a lower housing portion and an enlarged upper housing portion connected thereto and defining a shoulder therebetween, the shoulder engaging adjacent upper portions of the pill container when the closure cap is secured thereon, the shoulder having an opening therein;

biasing a switch member outwardly from the opening in the shoulder and being movable between an outwardly extending position to a retracted position based upon contact with adjacent upper portions of the pill container as the closure cap is secured thereon; and generating an indication relating to a length of time since the closure cap was most recently secured onto the pill container based upon a length of time since the switch member was most recently moved to the retracted position.

20. A method according to claim 19 wherein generating comprises displaying the length of time since the switch member was most recently moved to the retracted position.

21. A method according to claim 19 wherein generating comprises using a timer carried by the housing.

22. A method according to claim 19 wherein the switch member comprises a cylindrical pin.

23. A method according to claim 19 wherein the lower housing portion comprises a threaded outer surface portion.

24. A method according to claim 19 wherein the upper housing portion comprises an outer gripping surface.

25. A method for adapting a closure cap for use with a pill container comprising threads to use with a pill container comprising a child-proof locking mechanism, the closure cap comprising a timer and a housing carrying the timer, the housing comprising a shoulder portion and a threaded outer surface portion to engage threads of a pill container, the method comprising:

biasing a switch member from the shoulder portion of the housing and being movable between an outwardly extending position and a retracted position based upon contact with adjacent upper portions of the pill container as the closure cap is secured thereon, the switch member cooperating with the timer; and engaging a removable child-proof adaptor ring onto the housing to adapt the housing to engage the child-proof locking mechanism of the pill container.

26. A method according to claim 25 further comprising generating an indication relating to a length of time since a closure cap was most recently secured onto a pill container based upon a length of time since the switch member was most recently moved to the retracted position.

27. A method according to claim 26 wherein generating comprises displaying the length of time since the switch member was most recently moved to the retracted position.

28. A method according to claim 25 wherein the housing comprises a lower housing portion and an enlarged upper housing portion connected thereto and defining a shoulder therebetween, the shoulder engaging adjacent upper portions of the pill container when the closure cap is secured thereon, the shoulder having an opening therein receiving the switch member.

29. A method according to claim 28 wherein the removable child-proof adaptor ring comprises:

an upper portion engaging adjacent outer surface portions of the upper housing portion; and a lower portion connected to said upper portion and being in radially spaced apart relation from adjacent surface portions of the lower housing portion.

* * * * *